US010022760B2

(12) United States Patent
Voges

(10) Patent No.: US 10,022,760 B2
(45) Date of Patent: Jul. 17, 2018

(54) CUT-TO-LENGTH STEEL COIL PROCESSING LINE WITH STRETCHER LEVELER AND TEMPER MILL

(71) Applicant: The Material Works, Ltd., Red Bud, IL (US)

(72) Inventor: Kevin C. Voges, Red Bud, IL (US)

(73) Assignee: THE MATERIAL WORKS, LTD., Red Bud, IL (US)

( * ) Notice: Subject to any disclaimer, the term of this patent is extended or adjusted under 35 U.S.C. 154(b) by 263 days.

(21) Appl. No.: 14/873,539

(22) Filed: Oct. 2, 2015

(65) Prior Publication Data

US 2017/0095848 A1 Apr. 6, 2017

(51) Int. Cl.
*B21B 15/00* (2006.01)
*B21B 1/28* (2006.01)
(Continued)

(52) U.S. Cl.
CPC ..... *B21B 15/0007* (2013.01); *B21B 1/28* (2013.01); *B21D 25/00* (2013.01); *B21B 37/165* (2013.01);
(Continued)

(58) Field of Classification Search
CPC .... B21B 1/24; B21B 1/26; B21B 1/28; B21B 2001/228; B21B 2013/021;
(Continued)

(56) References Cited

U.S. PATENT DOCUMENTS 3,292,402 A 12/1966 Obrien
3,429,164 A * 2/1969 Oganowski ..... B21D 1/05 72/161
(Continued)

FOREIGN PATENT DOCUMENTS

CN 2933634 8/2007
CN 202174408 U 3/2012
(Continued)

OTHER PUBLICATIONS

"Stretch Leveling CTL", BuTech Bliss, http://www.butechbliss.com/ctl_stretch.aspx.
(Continued)

*Primary Examiner* — Peter DungBa Vo
*Assistant Examiner* — Joshua D Anderson
(74) *Attorney, Agent, or Firm* — Thompson Coburn LLP; Matthew J. Himich

(57) ABSTRACT

A cut-to-length steel coil processing line has an un-coiling reel, a temper mill, a stretcher leveler, a shearer, and a stacking apparatus arranged to sequentially process a continuous length of sheet metal. The line may be configured such that the continuous length of the sheet metal is directed from the uncoiling reel through the temper mill to the stacking apparatus without processing through the stretcher leveler when a determined thickness of the continuous length of sheet metal is at or below a selected measurement criteria. In the alternative, the line may be configured such that the continuous length of the sheet metal is directed from the uncoiling reel through the stretcher leveler to the stacking apparatus without processing through the temper mill when the determined thickness of the continuous length of sheet metal is greater than the selected measurement criteria.

15 Claims, 7 Drawing Sheets

(51) Int. Cl.
*B21D 25/00* (2006.01)
*B21B 1/22* (2006.01)
*B21B 37/16* (2006.01)

(52) U.S. Cl.
CPC . *B21B 2001/228* (2013.01); *B21B 2015/0071* (2013.01)

(58) Field of Classification Search
CPC ..... B21B 2013/025; B21B 15/007; B21B 2015/0071; B21B 37/16; B21B 37/165; B21B 37/28; B21B 38/02; B21B 38/04; B21B 39/002; B21B 2261/04; B21B 2263/04
USPC ..... 72/160, 161, 205
See application file for complete search history.

(56) References Cited

U.S. PATENT DOCUMENTS 3,626,735 A 12/1971 Lebourg et al.
3,805,571 A 4/1974 Toda et al.
4,711,109 A * 12/1987 Rohde ..... B21B 37/28 72/11.7
4,751,838 A 6/1988 Voges
4,872,245 A 10/1989 Kawasaki et al.
5,579,658 A * 12/1996 Noe ..... B21D 1/05 72/130
5,820,704 A * 10/1998 Veyer ..... B21B 1/28 148/610
6,205,830 B1 3/2001 Voges
6,814,815 B2 11/2004 Voges
7,156,926 B2 1/2007 Voges
7,601,226 B2 10/2009 Voges et al.
8,062,095 B2 11/2011 Voges et al.
8,066,549 B2 11/2011 Voges et al.
8,074,331 B2 12/2011 Voges
8,128,460 B2 3/2012 Voges et al.
8,707,529 B2 4/2014 Voges
2002/0114884 A1 8/2002 Friedersdorf et al.
2002/0162375 A1 11/2002 Noe et al.
2007/0044531 A1 3/2007 Liefer et al.

FOREIGN PATENT DOCUMENTS

DE 19513999 A1 10/1996
DE 19625548 A1 1/1998
DE 19852078 A1 5/2000
DE 102011107171 A1 1/2013
JP H04284911 A 10/1992
WO 2014/113823 A1 7/2014

OTHER PUBLICATIONS

"Temper Mill CTL", BuTech Bliss, http://www.butechbliss.com/ctl_temper.aspx.

* cited by examiner

CUT-TO-LENGTH STEEL COIL PROCESSING LINE WITH STRETCHER LEVELER AND TEMPER MILL

BACKGROUND AND SUMMARY

The present disclosure relates to methods for processing steel coils in a cut-to-length and/or blanking line. The cut-to-length and/or blanking line will uncoil the sheet material, level it, and then cut it to the required length and stack it. The end product produced by a cut-to-length and/or blanking line is a flat sheet of material cut to a precise length tolerance.

As described in more detail below, in a cut-to-length and/or blanking line to level the coiled material, a stretcher leveler may be used or a temper mill may be used. Hot roll processing lines used to produce flat, stress-free sheets generally are two types, a stretcher leveler line or a temper mill line. The general description of a stretcher leveler is described in U.S. Pat. No. 4,751,838, which is incorporated herein by reference. The stretcher leveler stretches the material sufficiently to exceed the yield point in all the fibers of the strip from top to bottom and from edge to edge thus equalizing internal trapped stresses throughout the material. A stretcher leveler completes its work with usually only 0.3 to 0.5% elongation. The general description of a temper mill is described in U.S. Pat. No. 3,292,402, which is incorporated herein by reference. A temper mill eliminates randomly trapped internal stresses by elongating the material beyond its yield point by squeezing the material between two rolls with enough force to reduce its thickness. The typical amount of elongation in a temper mill is about 1 or 2%.

As described in more detail, the disclosure is directed to a processing line with both a temper mill and a stretcher leveler. The temper mill may be placed on-line and the stretcher leveler bypassed to process thin gage materials. Vice versa, the temper mill may be bypassed and the stretcher leveler may be placed on-line to process thicker gage material.

In one example, a small temper mill is integrated into a cut-to-length line having a stretcher leveler. The temper mill may be a 4 high or 2 high mill temper mill capable of handling coils having a gage thickness of between 16 gage (0.0598 inches) and 9 gage (0.1495). The temper mill may be configured to generate 75 kpsi maximum rolling stress and 2.5% elongation. The temper mill may be used to produce an improved surface finish and where there is concern for coil breaks. The temper mill may also provide increased production when compared to operations involved a stretcher leveler especially for thinner gages between 16 gage (0.0598 inches) and 9 gage (0.1495).

The stretcher leveler may be used for coils and/or sheets having a thickness of between 16 gage and ¾ inches. For the thicker sizes between 9 gage and ¾ inches, the slower speed of the stretcher leveler is not as critical since there is generally less warp in a thicker gage coil. The stretcher leveler may also be used for thin gage thickness coils, i.e. between 16 gage and 9 gage, having poor shape and/or where flatness is a concern.

DETAILED DESCRIPTION

Figure 1:
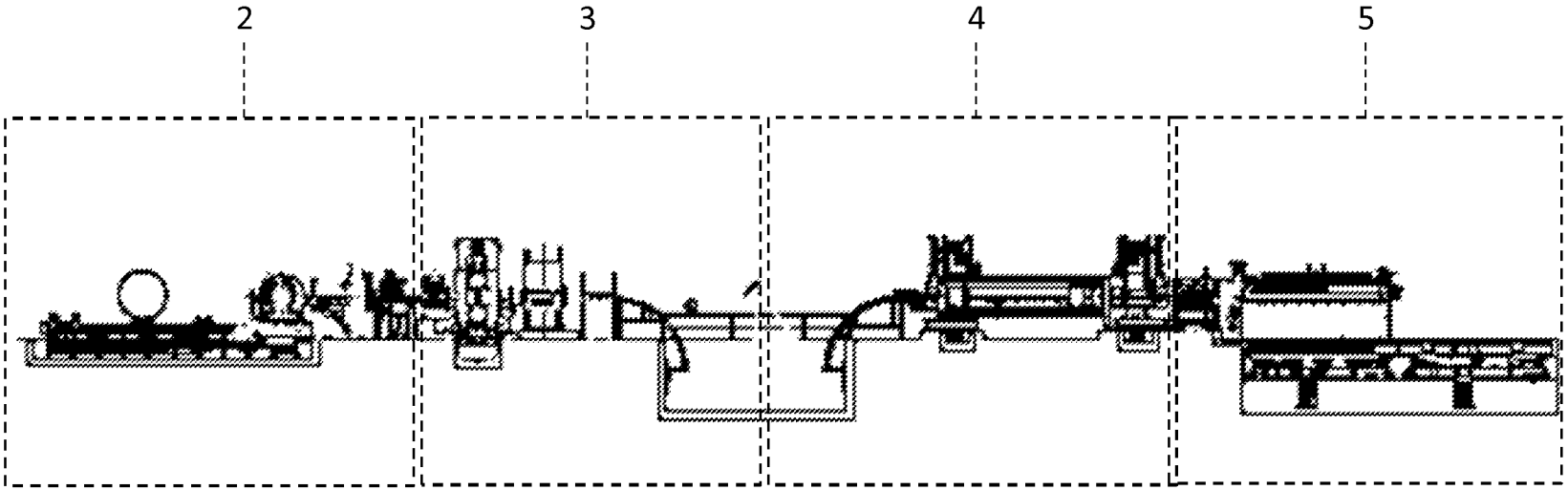
FIG. 1 illustrates a cut-to-length processing line with detail areas 2-5 corresponding to the drawing figures.

An exemplary cut-to-length and/or blanking line 10 is shown generally in FIGS. 1-5, and includes a coil 12 of sheet metal mounted on a reel 14, a straightener roller 16, a temper mill 18, roller leveler 20, a pit 22, a stretcher leveler 24, shearer 26, and a stacking apparatus 28.

Figure 2:
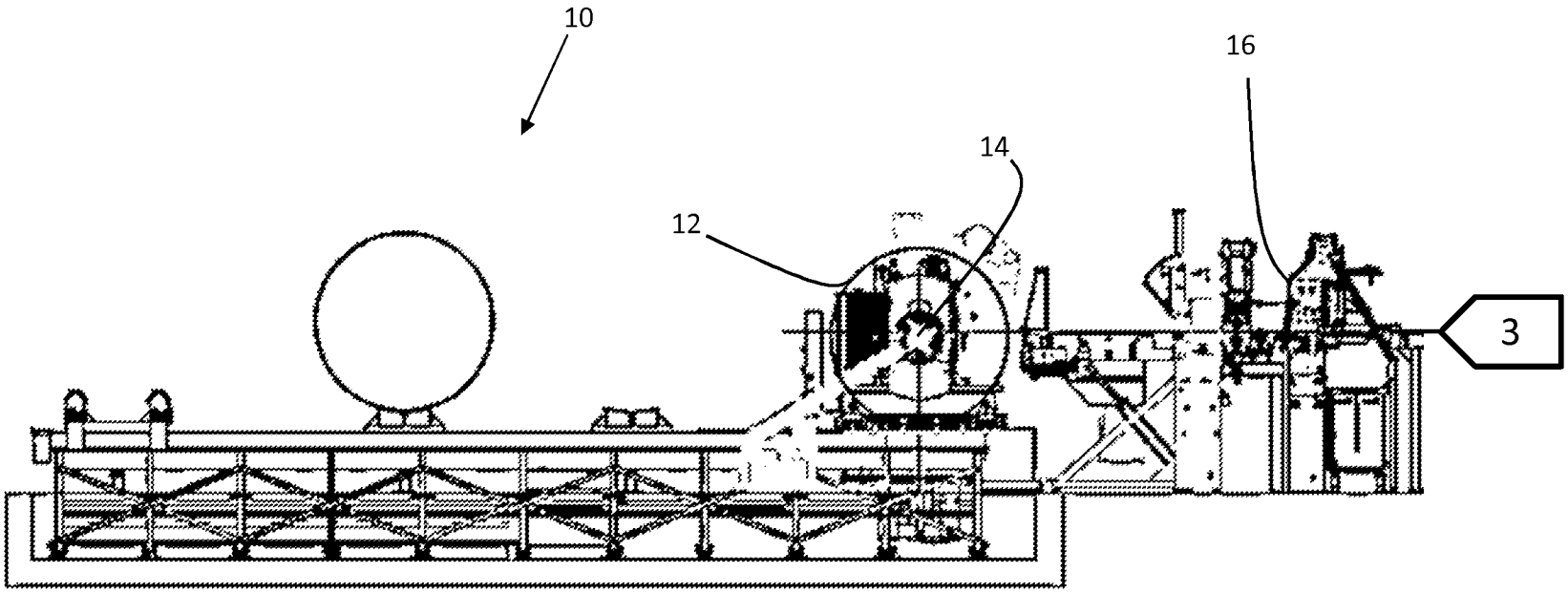
FIG. 2 is an enlarged view of detail area 2 of FIG. 1 corresponding to generally an uncoiler and guide rollers that direct the uncoiled sheet metal material through the line.

As shown best in FIG. 2, the straightener roller 16 is positioned just downstream of the reel 14. The straightener roller 16 includes a plurality of upper rollers and lower rollers having a relatively large diameter. At least some of the rollers are powered to withdraw the sheet metal strip from the coil at a uniform velocity. The upper and lower rollers are positioned relative to one another to put a deep reverse bend in the sheet sufficient to reverse any coil set. The reel 14 and straightener roller 16 are conventional.

Figure 3:
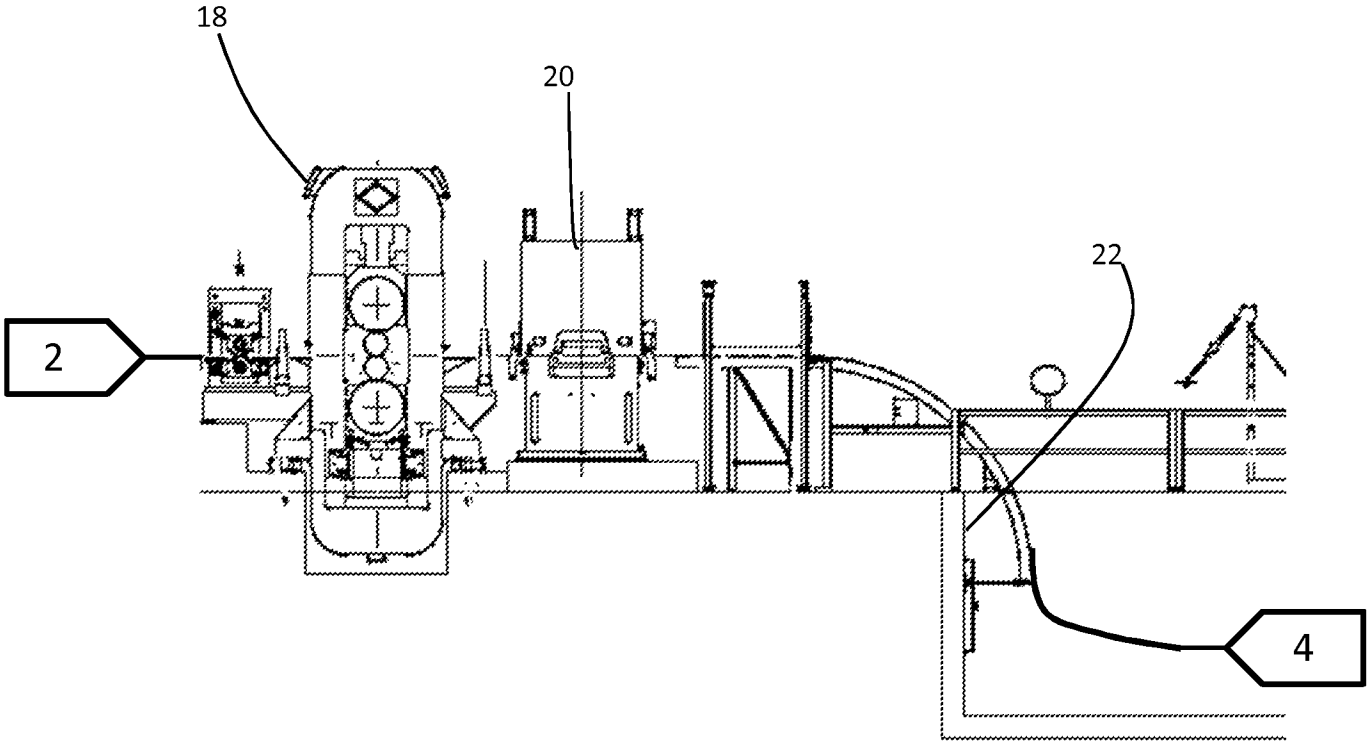
FIG. 3 is an enlarged view of detail area 3 of FIG. 1 corresponding to generally a temper mill and a roller level.

As shown best in FIG. 3, after the straightener roller 16, the temper mill 18, and if desired a roller leveler 20, are provided. The temper mill 18 may be a 4 high or 2 high mill temper mill capable of handling sheets having a gage thickness of between 16 gage (0.0598 inches) and 9 gage (0.1495). The temper mill 18 may be configured to generate 75 kpsi maximum rolling stress and 2.5% elongation. The roller leveler 20 may be provided in conjunction with the temper mill 18 to further enhance the flatness of relatively thin gages of sheet metal material. Depending upon the application, the roller leveler 20 and the temper mill 18 may be used together to correct the shape of thin gage sheet metal material. While the temper mill 18 may stress relieve the sheet metal material, the roller leveler 20 may be needed to provide additional flatness for the sheet metal material. The roller leveler 20 may also be necessary to remove defects such as edge wave or center buckle. The roller leveler 20 may be used to bend the sheet metal material progressively up and down over rolls of sufficient diameter to stretch the outer and inner surfaces of the material past the yield point. The roller leveler 20 may also be used to selectively stretch the sheet metal material from side to side. The roller leveler 20 may be used without the temper mill 18 depending upon the condition of the continuous length of sheet metal. The roller leveler is conventional.

As shown in FIG. 3, the take up pit 22 is positioned just downstream of the roller leveler 20 and prior to the stretcher leveler 24. The take-up pit 22 may be used primarily in connection with the stretcher leveler 24. As the sheet metal material is advanced incrementally through the stretcher leveler 24 during successive stretching operations, the take up pit 22 allows the strip to accumulate during short periods of time as the portions of the sheet metal strip are advancing incrementally through the stretcher leveler. The take up pit is conventional. The take up pit may not be needed with when operating the temper mill portion of the line in which case the take-up pit can be elevated into a position so that the sheet metal material passes straight through the line without extending into the pit. The elevation mode of the take-up pit also conventional.

Figure 4:
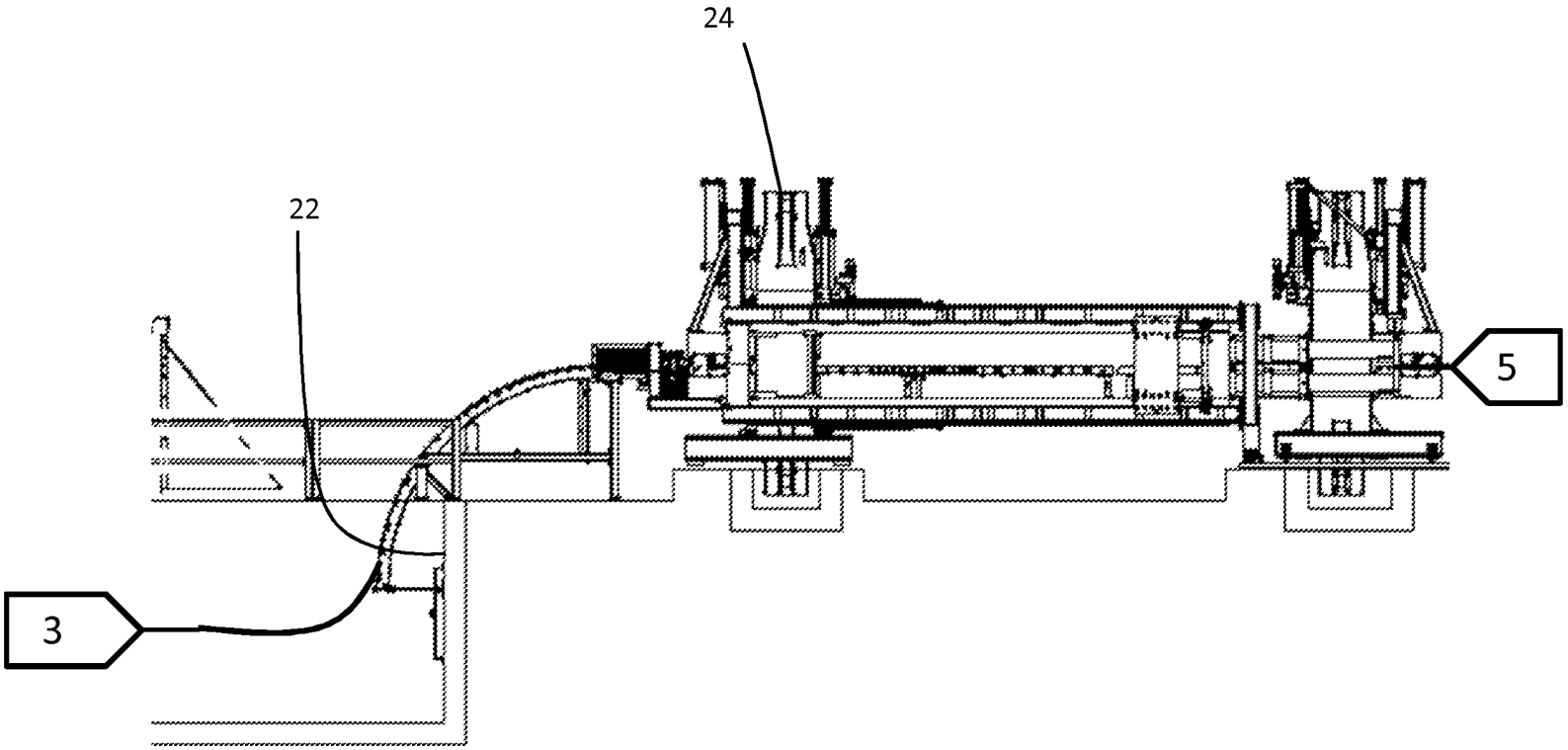
FIG. 4 is an enlarged view of detail area 4 of FIG. 1 corresponding to generally a stretcher leveler.

As shown best in FIG. 4, after the take up pit 22, the stretcher leveler 24 may be provided. The stretcher leveler 24 may include a plurality of powered rollers for pulling the sheet metal strip through the stretcher leveler. A feeding mechanism of the stretcher 24 leveler may advance the sheet metal strip through the stretcher leveler at precisely measured increments. Between the incremental advances of the strip, the stretcher leveler 24 may clamp down on a segment of the strip that is within the stretcher leveler and stretch the segment beyond its yield point to eliminate internal residual stresses, thereby leveling that segment. After the segment has been stretched, the stretcher leveler 24 may release the strip and advance the strip so that the next segment of strip can be stretched. Preferably, the length of the incremental advances of the strip does not exceed the length of the segment being stretched, so the entire strip can be stretched through the successive stretching operations. Generally speaking, the stretcher leveler consists of a pair of entry and exit frames that are adjustable relative to the desired length of the segment to be stretched. During stretching, each frame grips the segment to be stretched across its width. Large hydraulic cylinders extend between the two frames. When pressurized, the cylinders push the frames away from one another thereby stretching the segment clamped therebetween. The segment is subsequently stretched in the direction of travel. The feed mechanism feeds the sheet metal material through the leveler incrementally. Between feed cycles, while the material is stopped to be sheared to length, a portion of the strip is stretched. The stretcher leveler is conventional.

Figure 5:
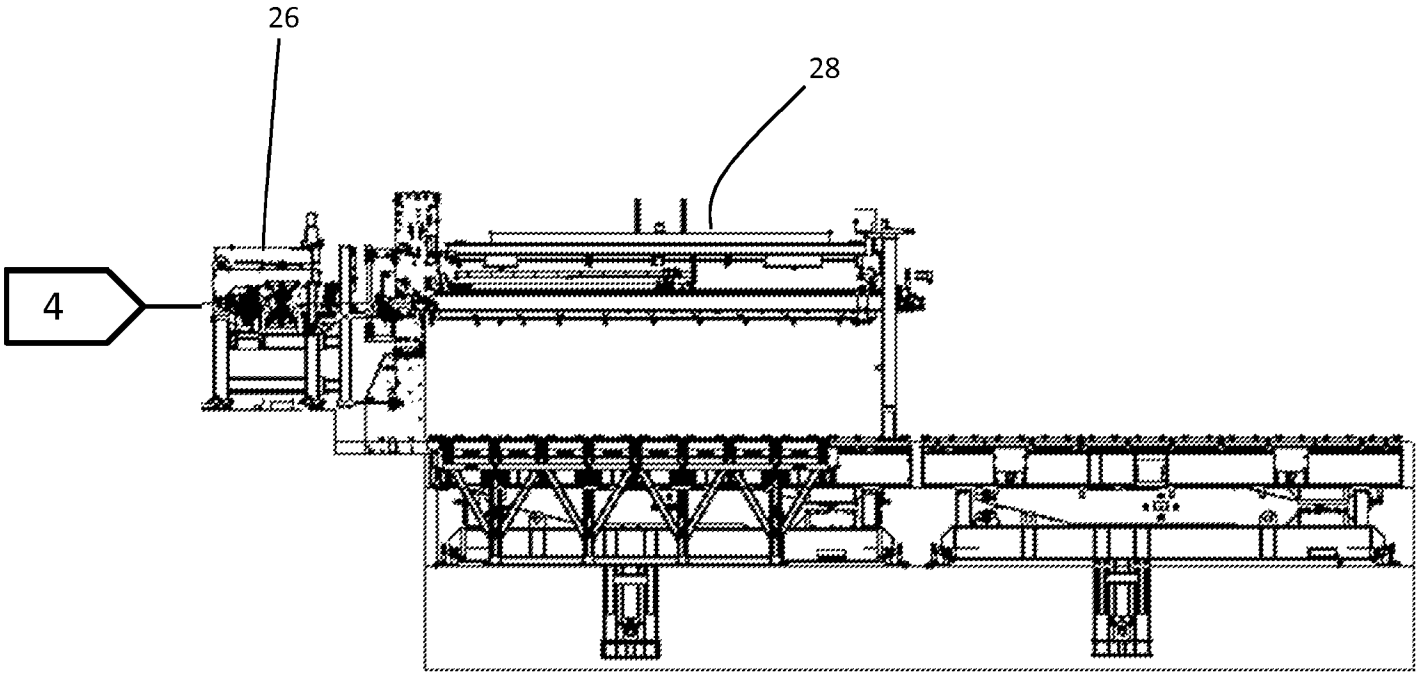
FIG. 5 is an enlarged view of detail area 5 of FIG. 1 corresponding to generally a sheet stacker.

As shown best in FIG. 5, the processing line 10 includes a shearer 26 and stacking apparatus 28. The shear may comprise a rotary shearer 26. A rotary shear has proven effective for use with thin gage materials in a temper mill cut-to-length blanking line where the sheet metal strip is continuously fed through the line. The shearer 26 may also comprise a direct drive mechanical shear. A direct drive mechanical shear has proven effective for use with thicker gage materials in a stretcher leveler cut-to-length blanking line where the sheet metal strip is incrementally fed through the line. The line may include both types of shearers. The stacking apparatus 28 may be a drop arm stacker and may include a lift table. The rotary shear, direct drive mechanical shear, and stacker are conventional.

A cut-to-length processing line with a stretcher leveler provides some advantages over a cut-to-length processing line having a temper mill. In particular, the stretcher leveler tends to produce flatter, continuous lengths of sheet metal when compared to a temper mill. In a stretcher leveler, the resulting product leveler tends to have no residual stresses and tends to maintain shape over time. Stretcher leveling operations generally have minimal effect on the physical and mechanical properties of the continuous length of sheet metal. A cut-to-length processing line with a stretcher leveler is generally easier to operate than a cut-to-length processing line with a temper mill. A typical stretcher leveler cut-to-length processing line includes a capital investment of approximately $7 million. This tends to be less than a temper mill cut-to-length processing line. The temper mill cut-to-length processing line generally includes a capital investment of approximately $20 million.

On the other hand, a cut-to-length temper mill processing line provides some advantages over a cut-to-length stretcher leveler processing line. Generally speaking, temper mill processed material has an improved surface finish when compared to stretcher leveler processed material, which is usually desired on the thinner gage, i.e., 16 gage-9 gage, materials. Often, temper mill processing allows for faster through-put time. The temper mill also increases the yield point elongation of material which helps to prevent coil breaks often found in softer and thinner, e.g., 16 gage-9 gage, materials. Continuous lengths of sheet metal processed in a stretcher leveler cut-to-length processing line generally does very little to prevent these undesirable coil breaks.

To achieve the advantages of both a traditional stretcher level cut-to-length processing line and a temper mill cut-to-length processing line, a temper mill may be incorporated into a stretcher leveler cut-to-length processing line as shown in FIGS. 1 through 5, via retrofitting or via new construction. The added cost from incorporating the temper mill to the stretcher leveler cut-to-length processing line involves an additional capital investment of about $5 million, which brings the total cost of such a line to $11 million. This represents a smaller capital investment than is required for a temper mill cut-to-length processing line, especially a temper mill cut-to-length processing line configured to process large gauge thickness sheet metal.

In accordance with a method involving a cut-to-length steel coil processing line, for instance, as shown in FIGS. 1-5, a thickness of the continuous length of sheet metal may be determined and compared to a selected measurement criteria. The processing line may be configured in one of two configurations based upon the comparison of the determined thickness to the selected measurement criteria. When the comparison indicates that the determined thickness is at or below the selected measurement criteria, the processing line may be configured in a configuration that directs the continuous length of sheet metal from the uncoiling reel through the temper mill to the stacking apparatus without passing through the stretcher leveler. In this configuration, the roller leveler following the temper mill may be on-line. When the comparison indicates that the determined thickness is greater than the selected measurement criteria, the processing line may be configured such that the continuous length of sheet metal is directed from the uncoiling reel through the stretcher leveler to the stacking apparatus without passing through the temper mill. When the processing line includes a roller leveler, which is usually used in connection with temper mill processing, the roller leveler may be involved without involving the temper mill in the processing when the determined thickness of the sheetmetal is less than or at the selected measurement criteria and when that material does not need to be extremely flat or stress relieved. When the determined thickness is greater than the selected measurement criteria, the continuous length of sheet metal may be directed from the uncoiling reel through the stretcher leveler to the stacking apparatus without passing through the temper mill and the roller leveler.

The processing line may also include a pit prior to the stretcher leveler. When the stretcher leveler is used, the continuous length of sheet metal may be directed from the uncoiling reel through the pit to the stretcher leveler and to the stacking apparatus without passing through the temper mill. When the determined thickness of the continuous length of sheet metal is at or below the selected measurement criteria, the continuous length of sheet metal may be directed from the uncoiling reel through the temper mill to the stacking apparatus with the take-up pit in the upward position and the stretcher leveler not on-line.

Figure 6:
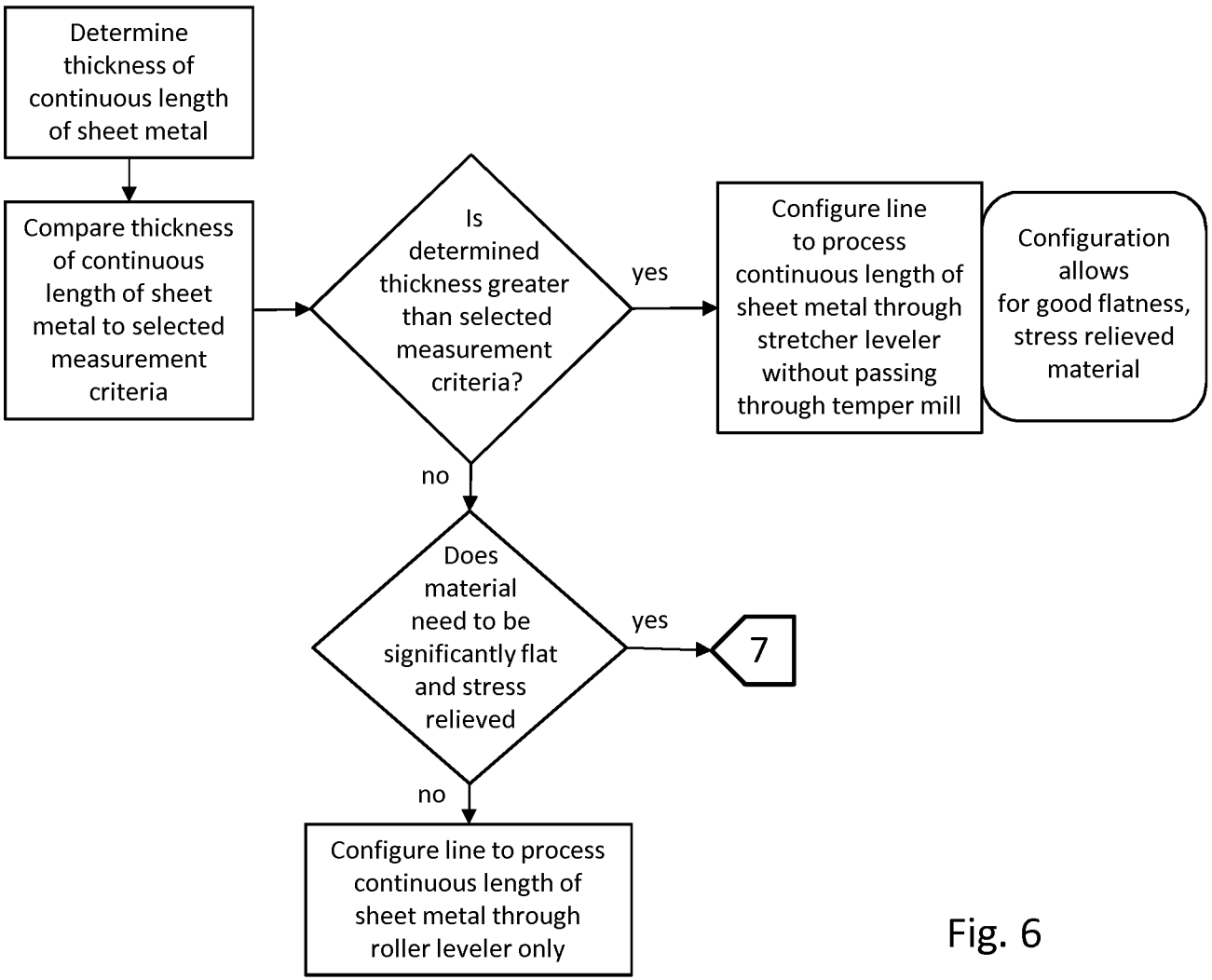
FIG. 6 is an initial process flow showing a method of operating the processing line of FIGS. 1-5.

As shown in FIG. 6, the configuration of the line may be in part based upon a determination of the thickness of the incoming material and a comparison of the thickness of the sheet metal to a selected measurement criteria. For instance, if the determined thickness is greater than the selected measurement criteria, the processing line may be configured to process continuous length of sheet metal through stretcher leveler without passing through temper mill. Such a configuration allows for generally good flatness, and stress relieved material. If, on the other hand, the determined thickness is less than or at the selected measurement criteria, the processing line may be configured based a determination of the shape of the incoming material, and requirements for stress relief, flatness, and/or surface finish requirements. By way of example and not in any limiting sense, if stress relief and significant flatness are not requirements, the line may configured to process the continuous length of sheet metal through roller leveler without passing through temper mill or stretcher leveler. If the material is required to be stress relieved and significantly flat, the material may be processed using other equipment on the line as described below and by example shown in FIG. 7.

Figure 7:
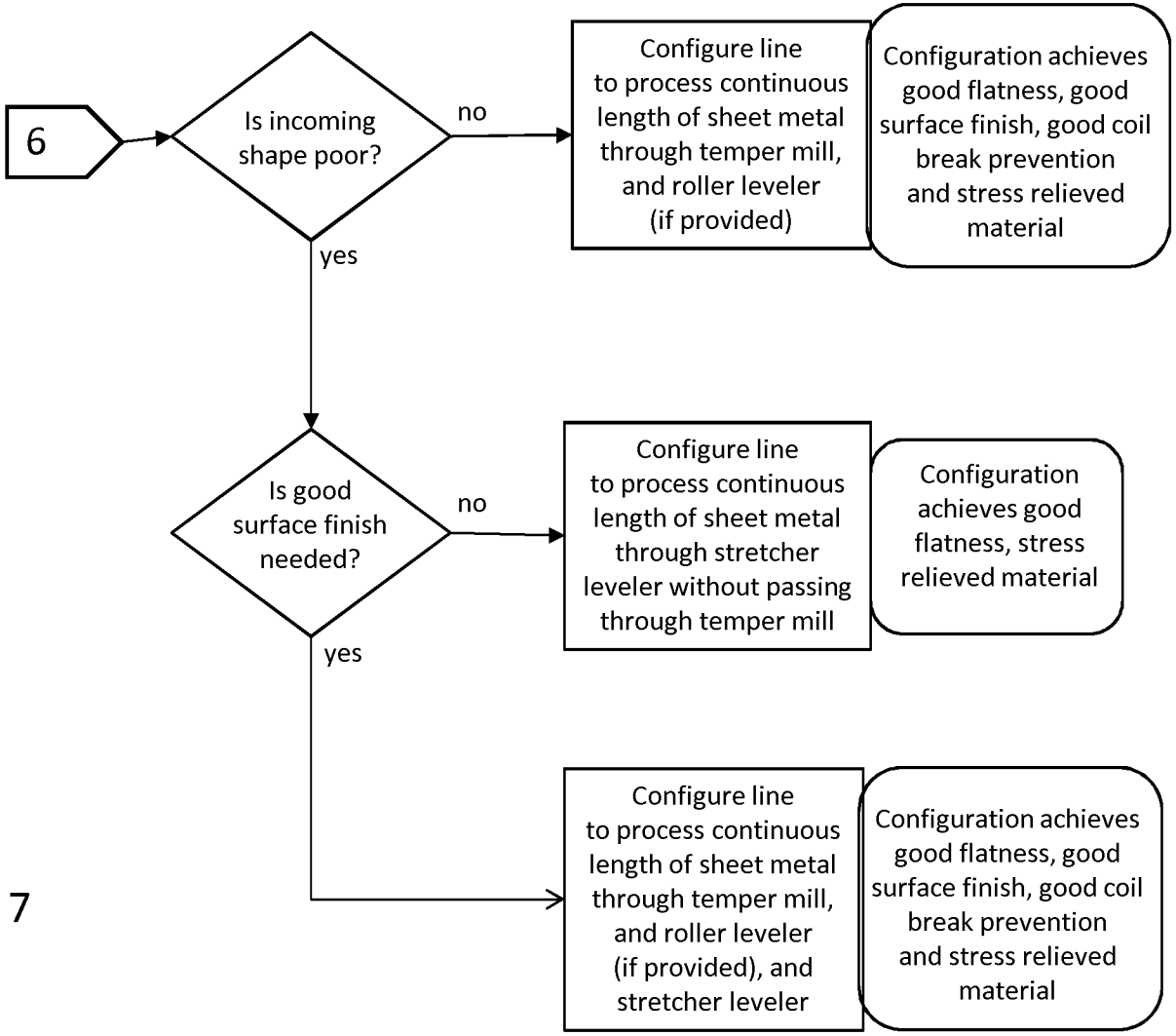
FIG. 7 is a further process flow showing other methods of operating the processing line of FIGS. 1-5.

As shown in FIG. 7, if the incoming material has generally good shape, i.e., no warp, crowning, bow, residual coil set, flatness, etc., the processing line may be configured to process the continuous length of sheet metal through temper mill without passing through stretcher leveler. This configuration can also be chosen to achieve good flatness, stress relieved material, good surface finish, and/or good coil break prevention. If, on the other hand, the incoming material shape, i.e., warp, crowning, bow, residual coil set, flatness, etc., is generally poor, the processing line may be configured depending upon a desired surface finish as shown in FIG. 7.

Referring to FIG. 7, if the material has no requirement for surface finish, the processing line may be configured to process continuous length of sheet metal through stretcher leveler without passing through temper mill. Such a configuration allows for generally good flatness, and stress relieved material. If, on the other hand, there is a requirement for good surface finish, the processing line may be configured to process the continuous length of sheet metal through temper mill, roller leveler (if provided), and the stretcher leveler. This configuration achieves good flatness, stress relieved material, good surface finish, and good coil break prevention.

As to the configuration of the processing line, the operator of the line may perform the steps of configuring the line based upon the operator's determination of the coil condition, material thickness, and ultimate material requirements in the manner described above. In the alternative, the operator of the line may receive instructions from another in selecting and configuring the processing line based upon coil condition, material thickness, and ultimate material requirements. For instance, an operator of the processing line may receive instructions to configure the line in connection with the installation of a temper mill in an existing stretcher leveler line. By way of example and not in any limiting sense, a temper mill may be retrofitted in an existing stretcher leveler line and the operator of the line may receive instructions for processing the continuous length of sheet metal in the line from an integrator, a provider of the temper mill, a process improvement consultant, or a retrofitting contractor. The operator may also receive instructions from a provider of a processing line comprising the stretcher leveler equipment and temper mill.

In view of the foregoing, it will be seen that the several advantages of the invention are achieved and attained. The embodiments were chosen and described in order to best explain the principles of the disclosure and their practical application to thereby enable others skilled in the art to best utilize the principles in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. In a cut-to-length steel coil processing line having an un-coiling reel followed by a temper mill followed by a stretcher leveler followed by a shearer followed by a stacking apparatus arranged to sequentially process a continuous length of sheet metal, a method comprising:

determining a thickness of the continuous length of the sheet metal;

comparing the determined thickness to a selected measurement criteria;

configuring the processing line in one of first and second configurations based upon the comparison of the determined thickness to the selected measurement criteria;

wherein when the comparison indicates that the determined thickness is at or below the selected measurement criteria, the processing line is configured in the first configuration comprising placing the temper mill on-line and the stretcher leveler not on-line followed by directing the continuous length of the sheet metal from the uncoiling reel to be processed through the temper mill and the stacking apparatus without processing through the stretcher leveler by bypassing the stretcher leveler; and wherein when the comparison indicates the determined thickness is greater than the selected measurement criteria, the processing line is configured in the second configuration comprising placing the temper mill not on-line and the stretcher leveler on-line followed by directing the continuous length of the sheet metal from the uncoiling reel to be processed through the stretcher leveler and the stacking apparatus without processing through the temper mill by bypassing the temper mill.

2. The method of claim 1 wherein the processing line includes a roller leveler following the temper mill; and the step of configuring comprises:

as to the first configuration, directing the continuous length of the sheet metal from the uncoiling reel through the temper mill and the roller leveler to the stacking apparatus without processing through the stretcher leveler; and as to the second configuration, directing the continuous length of the sheet metal from the uncoiling reel through the stretcher leveler to the stacking apparatus without processing through the temper mill or the roller leveler.

3. The method of claim 1 wherein the processing line includes a pit prior to the stretcher leveler; and the step of configuring comprises:

as to the first configuration, directing the continuous length of the sheet metal from the uncoiling reel through the temper mill to the stacking apparatus without processing through the pit or the stretcher leveler; and as to the second configuration, directing the continuous length of the sheet metal from the uncoiling reel through the pit and the stretcher leveler to the stacking apparatus without processing through the temper mill.

4. The method of claim 1, wherein the comparison step comprises comparing the determined thickness to the selected measurement criteria of a 9 standard gage.

5. The method of claim 1, wherein the configuration step comprises a two high temper mill.

6. A method comprising:

in a cut-to-length steel coil processing line having an un-coiling reel followed by a temper mill followed by a stretcher leveler followed by a shearer followed by a stacking apparatus arranged to sequentially process a continuous length of sheet metal, selecting one of first and second configurations for the processing line based upon a comparison of a thickness of the sheet metal and a selected measurement criteria, the first configuration comprising placing the temper mill on-line and the stretcher leveler not on-line followed by directing the continuous length of the sheet metal from the uncoiling reel to be processed through the temper mill and the stacking apparatus without processing through the stretcher leveler by bypassing the stretcher leveler when a determined thickness of the continuous length of the sheet metal is at or below the selected measurement criteria; and the second configuration comprising placing the temper mill not on-line and the stretcher leveler on-line followed by directing the continuous length of the sheet metal from the uncoiling reel to be processed through the stretcher leveler and the stacking apparatus without processing through the temper mill by bypassing the temper mill when the determined thickness of the continuous length of the sheet metal is greater than the selected measurement criteria.

7. The method of claim 6 wherein the processing line includes a roller leveler following the temper mill; and the step of selection comprises:

as to the first configuration, selecting the continuous length of the sheet metal to be directed from the uncoiling reel through the temper mill and the roller leveler to the stacking apparatus without processing through the stretcher leveler; and as to the second, selecting the continuous length of the sheet metal to be directed from the uncoiling reel through the stretcher leveler to the stacking apparatus without processing through the temper mill or the roller leveler.

8. The method of claim 7 wherein the processing line includes a pit prior to the stretcher leveler; and the step of selection comprises:

as to the first configuration, selecting the continuous length of the sheet metal to be directed from the uncoiling reel through the temper mill and the roller leveler to the stacking apparatus without processing through the pit and the stretcher leveler; and as to the second configuration, selecting the continuous length of the sheet metal to be directed from the uncoiling reel through the pit and the stretcher leveler to the stacking apparatus without processing through the temper mill or the roller leveler.

9. The method of claim 6 wherein the comparison step comprises comparing the determined thickness to the selected measurement criteria of a 9 standard gage.

10. The method of claim 6 wherein the configuration step comprises a two high temper mill.

11. A method comprising:

in a cut-to-length steel coil processing line having an un-coiling reel followed by a temper mill followed by a stretcher leveler followed by a shearer followed by a stacking apparatus arranged to sequentially process a continuous length of sheet metal, directing a user to configure the processing line in one of first and second configurations based upon a comparison of a thickness of the sheet metal and a selected measurement criteria, the first configuration comprising placing the temper mill on-line and the stretcher leveler not on-line followed by directing the continuous length of the sheet metal from the uncoiling reel to be processed through the temper mill and the stacking apparatus without processing through the stretcher leveler by bypassing the stretcher leveler when a determined thickness of the continuous length of the sheet metal is at or below the selected measurement criteria; and the second configuration comprising placing the temper mill not on-line and the stretcher leveler on-line followed by directing the continuous length of the sheet metal from the uncoiling reel to be processed through the stretcher leveler and the stacking apparatus without processing through the temper mill by bypassing the temper mill when the determined thickness of the continuous length of the sheet metal is greater than the selected measurement criteria.

12. The method of claim 11 wherein the processing line includes a roller leveler following the temper mill; and the step of directing the user to configure the processing line comprises:

as to the first configuration, directing the continuous length of the sheet metal from the uncoiling reel through the temper mill and the roller leveler to the stacking apparatus without processing through the stretcher leveler; and as to the second, directing the continuous length of the sheet metal from the uncoiling reel through the stretcher leveler to the stacking apparatus without processing through the temper mill or the roller leveler.

13. The method of claim 12 wherein the processing line includes a pit prior to the stretcher leveler; and the step of directing the user to configure the processing line comprises:

as to the first configuration, directing the continuous length of the sheet metal from the uncoiling reel through the temper mill and the roller leveler to the stacking apparatus without processing through the pit and the stretcher leveler; and as to the second configuration, directing the continuous length of the sheet metal from the uncoiling reel through the pit and the stretcher leveler to the stacking apparatus without processing through the temper mill or the roller leveler.

14. The method of claim 11 wherein the comparison step comprises comparing the determined thickness to the selected measurement criteria of a 9 standard gage.

15. The method of claim 11 wherein the configuration step comprises a two high temper mill.

* * * * *